US009417025B1

(12) United States Patent
McDonald

(10) Patent No.: US 9,417,025 B1
(45) Date of Patent: Aug. 16, 2016

(54) APPARATUS HAVING CLAMP DEVICE AND FORESTOCK-SUPPORT MEMBER FOR FIREARM

(71) Applicant: Franklin Arnold McDonald, Spruce Grove (CA)

(72) Inventor: Franklin Arnold McDonald, Spruce Grove (CA)

( * ) Notice: Subject to any disclaimer, the term of this patent is extended or adjusted under 35 U.S.C. 154(b) by 0 days.

(21) Appl. No.: 14/833,269

(22) Filed: Aug. 24, 2015

(51) Int. Cl.
*F41A 23/02* (2006.01)

(52) U.S. Cl.
CPC ..... *F41A 23/02* (2013.01)

(58) Field of Classification Search
CPC ..... F41A 23/02; F41A 23/04; F41A 23/06; F41A 23/08; F41A 23/10; F41A 23/12; F41A 23/14; F41A 23/16; F41A 23/18
USPC ..... 42/94; 89/37.04, 37.01
See application file for complete search history.

(56) References Cited

U.S. PATENT DOCUMENTS

| | | | | |
|---|---|---|---|---|
| 3,022,898 | A | 2/1962 | Loeb | |
| 3,225,656 | A | 12/1965 | Flaherty et al. | |
| 4,026,057 | A | 5/1977 | Cady | |
| 4,345,398 | A | 8/1982 | Pickett | |
| 4,903,929 | A * | 2/1990 | Hoffman | B25B 5/003 24/335 |
| 4,913,391 | A * | 4/1990 | Klipp | F41A 23/02 248/214 |
| 4,924,616 | A | 5/1990 | Bell | |
| 4,998,944 | A | 3/1991 | Lund | |
| 5,481,817 | A | 1/1996 | Parker | |
| 5,857,651 | A | 1/1999 | Kunevicius | |
| 6,032,911 | A * | 3/2000 | Osborne | F41A 23/18 248/229.15 |
| 6,315,256 | B1 | 11/2001 | Tolar | |
| 6,802,483 | B1 | 10/2004 | Leasure | |
| 6,920,713 | B1 | 7/2005 | Love | |
| 6,951,072 | B2 | 10/2005 | Schurtenberger | |
| 7,493,719 | B2 | 2/2009 | Lackey | |
| 8,087,195 | B2 | 1/2012 | Minges | |
| 8,297,565 | B2 * | 10/2012 | McLinda | A01K 97/10 248/157 |
| 8,322,067 | B2 | 12/2012 | Boord | |
| 8,544,202 | B2 | 10/2013 | Bastian | |
| 2010/0154277 | A1 * | 6/2010 | Lee | F41A 23/16 42/94 |
| 2010/0301184 | A1 * | 12/2010 | Stabler | F16M 11/04 248/346.5 |
| 2011/0308131 | A1 * | 12/2011 | McLinda | F41A 23/06 42/94 |
| 2012/0174461 | A1 | 7/2012 | Potterfield et al. | |
| 2012/0227305 | A1 * | 9/2012 | Fontenot | F41A 23/02 42/94 |
| 2013/0086835 | A1 | 4/2013 | Minneman | |

* cited by examiner

*Primary Examiner* — Joshua Freeman
(74) *Attorney, Agent, or Firm* — Giuseppe Mariconda

(57) ABSTRACT

An apparatus is for use with a firearm having any one of a forestock and a barrel section and for use with an elongated stationary object. The apparatus includes a clamp device having a clamp portion. A forestock-support member is configured to make contact with any one of a forestock and a barrel section once the firearm is spatially positioned to do just so. A swivel connector is configured to extend from the clamp portion. The swivel connector is configured to rotatably couple the forestock-support member to the clamp portion. This is done in such a way that the forestock-support member, in use, pivotally swivels at will relative to the clamp portion once any one of a forestock and a barrel section (in use) contacts the swivel connector.

20 Claims, 6 Drawing Sheets

APPARATUS HAVING CLAMP DEVICE AND FORESTOCK-SUPPORT MEMBER FOR FIREARM

TECHNICAL FIELD

This document relates to the technical field of (and is not limited to) an apparatus for use with a firearm and for use with an elongated stationary object, in which the apparatus includes a clamp device, a forestock-support member and a swivel connector.

BACKGROUND

A firearm is a portable gun, being a barreled weapon that launches one or more projectiles often driven by the action of an explosive force. Most modern firearms have rifled barrels to impart spin to the projectile for improved flight stability (for improved accuracy of shot). A rifle is a firearm designed to be fired from the shoulder, with a barrel that has a helical groove or pattern of grooves (rifling) cut into the barrel walls. Rifles are used in hunting and shooting sports.

SUMMARY

It will be appreciated that there exists a need to mitigate (at least in part) at least one problem associated with existing firearms (also called the existing technology). After much study of the known systems and methods with experimentation, an understanding of the problem and its solution has been identified and is articulated as follows:

There are hunting situations in which the user (hunter) must have both hands placed on the rifle. The challenge faced by hunters with a firearm is to keep their firearm steady while having both hands on the firearm, while the user stands in the standing position (or other user stationary position). This can be especially challenging when the hunter desires to shoot their firearm at a moving target (while the hunter remains stationary, especially so for relatively longer shots).

For instance, when the hunter holds a rifle in a ready-to-shoot position, the hunter may conclude that holding the firearm is tiresome (while waiting for the quarry). As a result, hunter must assume a rest position (in which a shot is not fired from the rifle). The problem with holding the rifle (for prolonged periods of time) is that eventually, the hunter may experience unnecessary large-scale body uncontrollable movements that may scare away the quarry (game or target).

What is needed is an apparatus that provides a rifle support for the rifle (in the ready-to-shoot position) while the hunter (the user) scans the terrain (preferably from a hidden spot or a blind) by placing the rifle in or on the rifle support. Preferably, the rifle support provides or facilitates a left-to-right or right-to-left lateral movements of the hunter and/or the rifle. The rifle support may permit (A) a minimal or miniscule body movement of the hunter while the hunter scopes (views) the quarry while avoiding potentially alarming and scaring away the quarry (B) allows the hunter to remain relaxed, rested, ready and/or focused on his objective (the quarry or target), and/or (C) when the hunter has properly identified (seen) the quarry, the hunter may then switch from look mode to kill mode (preferably quickly as possible, such as in less than a second) without revealing his position (to the quarry). The apparatus, preferably, allows or improves the opportunity for the hunter to deliver a well-placed shot (preferably, every time).

To mitigate (at least in part) the above problem, amongst other things, there should be provided an apparatus for use with a firearm. The apparatus (at least in some part) provides support for a part of the firearm while allowing the user to swivel (rotate) while the firearm is (at least in part) provided with some amount of support. In this way, the hunter may track the moving target (with the firearm) while aiming and firing their firearm. While the firearm is rotated by the user, the apparatus assists the user in maintaining a steady gaze or line of sight on the moving target (by providing some support for the firearm while the user swivels the firearm to maintain their line of sight for shooting purposes).

To mitigate, at least in part, at least one problem associated with the existing technology, there is provided (in accordance with a major aspect) an apparatus. The apparatus is for use with a firearm having a forestock and barrel section for use with an elongated stationary object. The apparatus includes a clamp device including a clamp portion. A forestock-support member is configured to make contact with any one of the forestock and the barrel section of the firearm once the firearm is spatially positioned to do just so. It will be appreciated that the barrel section is part of the forestock, or the barrel section extends from the forestock of the firearm. A swivel connector is configured to extend from, at least in part, the clamp portion. The swivel connector is configured to rotatably couple the forestock-support member to the clamp portion of the clamp device at a predetermined position on the clamp portion; this is done in such a way that the forestock-support member, in use, pivotally swivels at will relative to the clamp portion once any one of the forestock and the barrel section (in use) contacts the swivel connector, and any one the forestock and the barrel section is made to move just so.

In accordance with an option, the swivel connector is configured to detach the forestock-support member from the predetermined position on the clamp portion of the clamp device in such a way that the forestock-support member is removable from the clamp portion of the clamp device.

In accordance with an option, the forestock-support member is configured to support any one of the forestock and the barrel section of the firearm at a spatial position relative to the elongated stationary object once the swivel connector is made to extend from the clamp portion, and the swivel connector is made to rotatably couple the forestock-support member to the clamp portion.

In accordance with an option, the forestock-support member, in use, makes contact with any one of the forestock and the rifle barrel of the firearm, once any one of the forestock and the barrel section is positioned to do just so. This is done in such a way that any one of the forestock and the barrel section and the forestock-support member, in use, swivel at will relative to the clamp portion in response to the user urging any one of the forestock and the barrel section of the firearm to cause rotational movement of the forestock-support member.

Other aspects are identified in the claims.

Other aspects and features of the non-limiting embodiments may now become apparent to those skilled in the art upon review of the following detailed description of the non-limiting embodiments with the accompanying drawings.

BRIEF DESCRIPTION OF THE DRAWINGS

The non-limiting embodiments may be more fully appreciated by reference to the following detailed description of the non-limiting embodiments when taken in conjunction with the accompanying drawings, in which.

Figure 1:
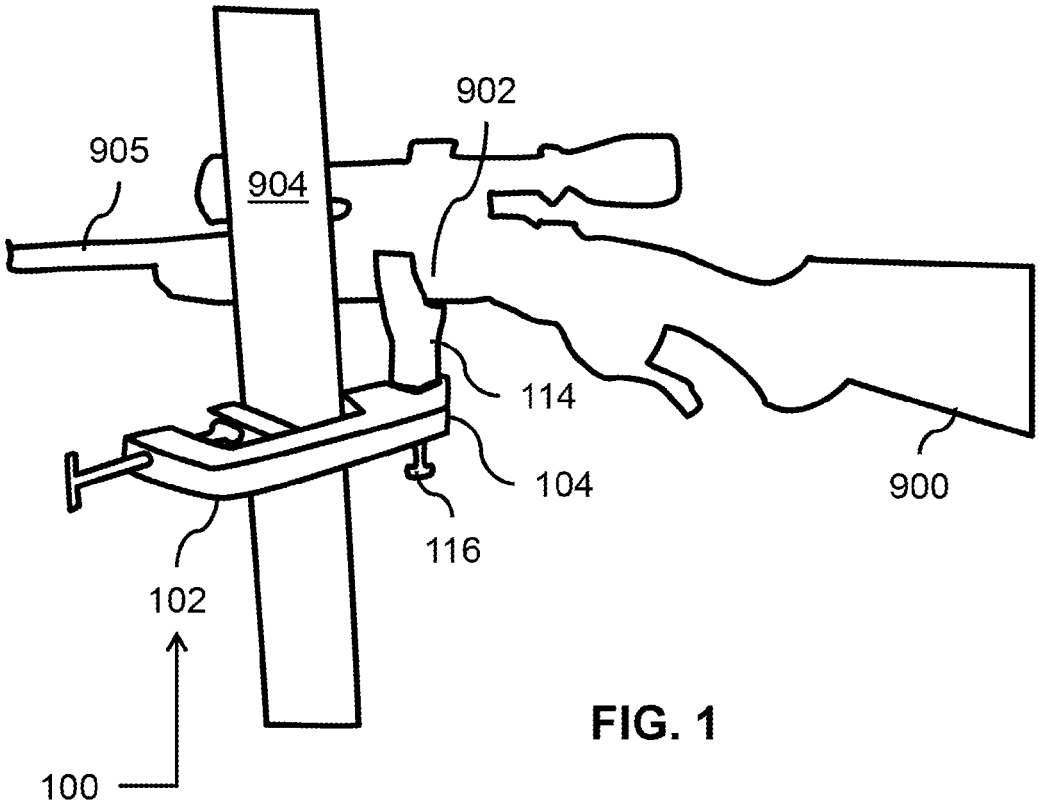
FIG. 1 (SHEET 1 of 6 SHEETS) depicts a perspective view of an embodiment of an apparatus for use with a firearm.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted.

Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

100 apparatus
102 clamp device
104 clamp portion
106 stationary jaw
108 stationary gripping teeth
110 movable jaw
112 movable gripping teeth
114 forestock-support member
116 swivel connector
118 corner section
120 lateral side walls
122 V-shaped formation
124 first elongated shaft
126 second elongated shaft
128 pin member
130 stop portion
132 threaded receiving hole
134 elongated rotatable shaft
136 passageway
138 handle assembly
140 C-shaped body
142 guide member
144 channel
900 firearm
902 forestock
903 barrel section
904 elongated stationary object
905 barrel section

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the invention is defined by the claims. For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described.

FIG. 1 depicts a perspective view of an embodiment of an apparatus 100 for use with a firearm 900.

The apparatus 100 is for use with the firearm 900 (such as, a rifle) having a forestock 902. The forestock 902 includes a barrel section 905. It will be appreciated that the barrel section 905 is part of the forestock 902, or the barrel section 905 extends from the forestock 902 of the firearm 900. For the case where the firearm 900 includes (is) a rifle, the barrel section 905 includes (is) a rifle barrel, and the forestock 902 includes (is) a rifle stock. It will be appreciated that any reference, in this description and/or in the claims, to the forestock 902 applies equally to the barrel section 905.

The apparatus 100 is also for use with an elongated stationary object 904. The elongated stationary object 904 may include (for instance) any one of a relatively smaller vertically extending tree, a vertically extending post, a walking stick, a trunk of a tree and object it can any equivalent thereof.

In accordance with the embodiment as depicted in FIG. 1, the apparatus 100 includes (and is not limited to) a synergistic combination of a clamp device 102, a forestock-support member 114 and a swivel connector 116.

The clamp device 102 includes (and is not limited to) a clamp portion 104 (such as a clamp handle, etc.). Preferably, the clamp device 102 is configured to clamp (directly or indirectly) the forestock-support member 114 to any type of stationary object (such as, the elongated stationary object 904). Referring to the embodiment as depicted in FIG. 1, the clamp device 102 is configured to attach (affixed attachment) to a trunk of the tree (which is an embodiment of the elongated stationary object 904). The clamp device 102 is also configured to detach from the elongated stationary object 904 (as required by the user). In accordance with a preferred embodiment, it will be appreciated that the clamp portion 104 is not intended to be removable from the forestock-support member 114 on a regular basis. It will be appreciated that the barrel section 905 may rest in the forestock-support member 114 instead of the forestock 902.

The forestock-support member 114 is configured to make contact with the forestock 902 (or with the barrel section 905) of the firearm 900 once the firearm 900 is spatially positioned to do just so (for instance, once the user spatially positions the firearm 900 in an abutting relationship with the forestock-support member 114). This is done in such a way that the forestock 902 (or with the barrel section 905) of the firearm 900 is made to abut or contact, at least in part, the forestock-support member 114. The forestock-support member 114 is configured to provide, at least in part, support for the forestock 902 (or with the barrel section 905). This is done in such a way that the user of the firearm 900 may steady the firearm 900 against the forestock-support member 114 while the user attempts to take aim at a potential target with the firearm 900.

The swivel connector 116 is configured to extend from the clamp portion 104. Preferably, the swivel connector 116 is configured to extend through, at least in part (or all the way through), the clamp portion 104. The swivel connector 116 is configured to rotatably couple the forestock-support member 114 to the clamp portion 104 of the clamp device 102 (preferably at a predetermined position on the clamp portion 104). This is done in such a way that the forestock-support member 114, in use, pivotally swivels (at will or freely) relative to the clamp portion 104 (once the forestock 902 (or with the barrel section 905) contacts the swivel connector 116 and the forestock 902 (or with the barrel section 905) is made to move just so (rotate just so). The swivel connector 116 is configured to detach the forestock-support member 114 from the predetermined position on the clamp portion 104 of the clamp device 102. This is done in such a way that the forestock-support member 114 is removable from the clamp portion 104 of the clamp device 102.

The forestock-support member 114 is configured to support the forestock 902 (or with the barrel section 905) of the firearm 900 at a spatial position relative to the elongated stationary object 904 once (A) the swivel connector 116 is made to extend from the clamp portion 104, and (B) the swivel connector 116 is made to rotatably couple the forestock-support member 114 to the clamp portion 104.

The forestock-support member 114, in use, makes contact with the forestock 902 of the firearm 900 once the forestock 902 (or with the barrel section 905) of the firearm 900 is positioned to do just so, by the user. This is done in such a way that the forestock 902 (or with the barrel section 905) of the firearm 900 and the forestock-support member 114, in use, swivel at will (or freely) relative to the clamp portion 104 in response to the user urging (moving) the forestock 902 (or with the barrel section 905) of the firearm 900 to cause rotational movement of the forestock-support member 114.

A technical effect (from amongst others) of the apparatus 100 is to provide support (improved stability) for the user (the shooter) of the firearm 900 for spotting, aiming and firing the firearm 900 with improved firearm-aiming accuracy (preferably, while keeping concealment intact for the user of the apparatus 100). In addition, the apparatus 100 reduces, at least in part, unwanted movement by the user. The apparatus 100 (in use) permits somewhat easier sighting of the potential target so that the user may be more prepared and ready to discharge the firearm 900; in this manner, the apparatus 100 improves the success rate for shooting at and hitting a target. In addition, the apparatus 100 may be positioned at different elevations (heights from the ground) in such a way as to facilitate user comfort for when the user is standing, crouching, sitting, etc.), preferably with less fatigue for the user and provides greater confidence (for the user) for using the firearm 900. The apparatus 100 may be knocked down into a compact state (and is relatively lightweight) for relatively easier transport and/or storage (into a pocket, knapsack, etc., and any equivalent thereof). The apparatus 100 allows for relatively quicker set-up (installment and use of the firearm 900). In addition, for added convenience, two instances of the apparatus 100 may be deployed (used) to add further positional support for the firearm 900 (during aiming of the firearm 900). It will be appreciated that the apparatus 100 is advantageous for open field shooting, where many trees are available for providing positional support for the firearm 900 (when using the apparatus 100) (once the apparatus 100 is fastened to a relatively smaller tree, a branch, a walking stick, etc., and any equivalent thereof). As well, the apparatus 100 provides a device configured to assist (the user) in maintaining steady positioning of the gun sight of the firearm 900, especially so for relatively longer-range shots. The apparatus 100 may be mounted to trees having a relatively smaller diameter, on the vertical trunk, and/or any type of substantially vertically aligned post (and any equivalent thereof). The apparatus 100 gives the user a suitable rifle barrel support once used as such.

Figure 2A:
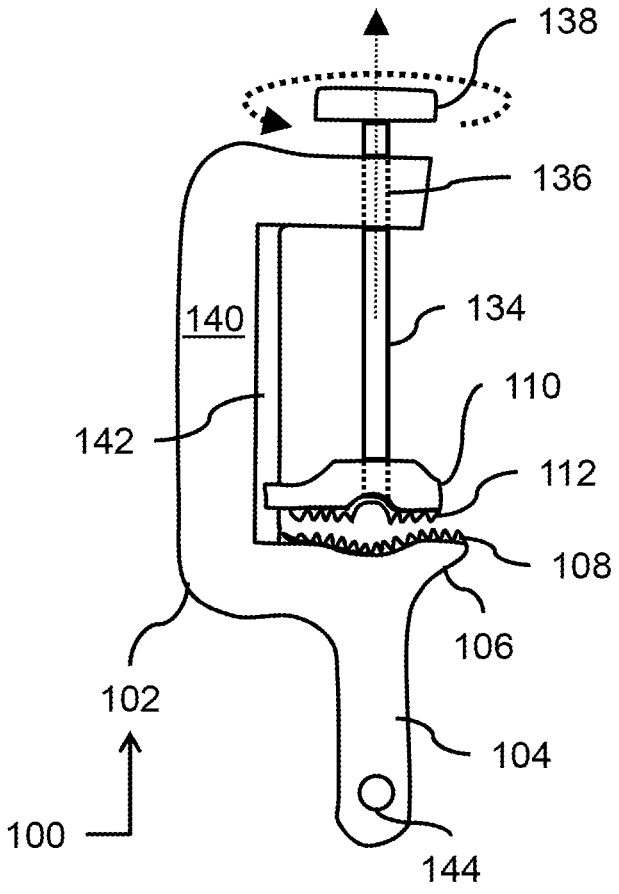
FIG. 2A, FIG. 2B and FIG. 2C (SHEETS 2 and 3 of 6 SHEETS) depict a top view, a side view and a top view (respectively) of embodiments of a clamp device of the apparatus of FIG. 1.
Figure 2B:
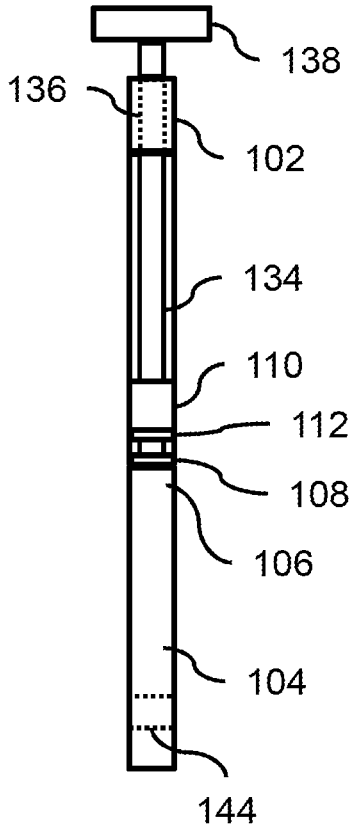
Figure 2C:
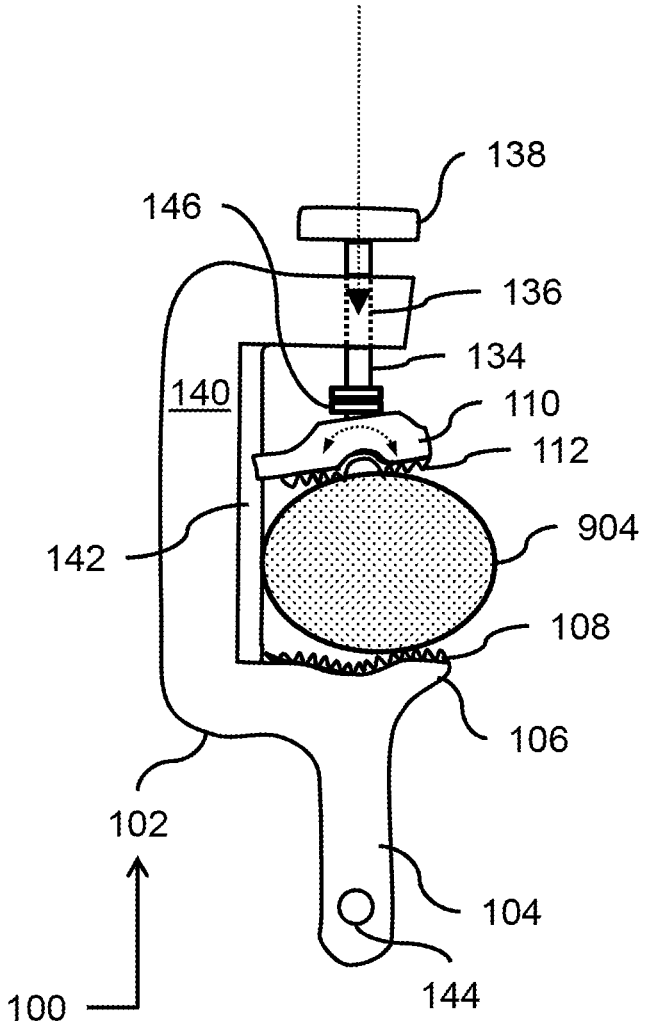

FIG. 2A, FIG. 2B and FIG. 2C depict a top view (FIG. 2A), a side view (FIG. 2B) and a top view (FIG. 2C) of embodiments of the clamp device 102 of the apparatus 100 of FIG. 1.

In accordance with the embodiment as depicted in FIG. 2, the clamp device 102 includes a synergistic combination of the clamp portion 104, a stationary jaw 106 presenting (configured to present) stationary gripping teeth 108, and a movable jaw 110 presenting (configured to present) movable gripping teeth 112.

The stationary jaw 106 extends from the clamp portion 104, with the stationary jaw 106 presenting (configured to present) the stationary gripping teeth 108.

The movable jaw 110 is movably engaged with the clamp portion 104 in such a way that the movable jaw 110 is movably positionable relative to the stationary jaw 106. The movable jaw 110 presents the movable gripping teeth 112 with the movable gripping teeth 112 movably facing the stationary gripping teeth 108 of the stationary jaw 106.

The movable jaw 110 is movable toward the stationary jaw 106. This is done in such a way that, once a cross-sectional portion of the elongated stationary object 904 is positioned between the movable jaw 110 and the stationary jaw 106, the movable gripping teeth 112 and the stationary gripping teeth 108 selectively fixedly securely attach to a cross-sectional portion of the elongated stationary object 904 (as depicted in FIG. 2C). In this manner, the clamp portion 104 becomes spatially clamped stationary to the cross-sectional portion of the elongated stationary object 904.

The movable jaw 110 is movable away the stationary jaw 106. This is done in such a way that, once the cross-sectional portion of the elongated stationary object 904 is positioned between the movable jaw 110 and the stationary jaw 106, the movable gripping teeth 112 and the stationary gripping teeth 108 are detached and are removable from the cross-sectional portion of the elongated stationary object 904 (so that the clamp portion 104 may be spatially moved away from the elongated stationary object 904).

In accordance with an embodiment, the movable gripping teeth 112 and the stationary gripping teeth 108 are preferably movable, at most, to about four inches apart from each other. Of course, other dimensions may be used (if so desired) between the movable gripping teeth 112 and the stationary gripping teeth 108.

In accordance with the embodiment as depicted in FIG. 2A and FIG. 2B, the clamp device 102 further includes an elongated rotatable shaft 134 extending from the movable jaw 110. The elongated rotatable shaft 134 defines (at least in part)

outwardly facing threads formed on the surface of the elongated rotatable shaft 134 that extend along a length of the elongated rotatable shaft 134.

In accordance with the embodiment as depicted in FIG. 2A and FIG. 2B, the clamp device 102 defines a passageway 136 configured to threadably receive and couple with the elongated rotatable shaft 134. A handle assembly 138 is fixedly attached to an end portion of the elongated rotatable shaft 134. In response to rotation of the handle assembly 138, the elongated rotatable shaft 134 threadably extends toward or away from the stationary jaw 106 (in order to open or close the stationary gripping teeth 108 and the movable gripping teeth 112 relative to each other).

Preferably, the clamp device 102 includes a C-shaped body 140, and the clamp portion 104 extends from the C-shaped body 140. The passageway 136 is defined on one side of the C-shaped body 140, with the stationary jaw 106 positioned on the opposite side of the C-shaped body 140. The clamp device 102 also includes a guide member 142. The guide member 142 extends along a length of the C-shaped body 140 and faces the elongated rotatable shaft 134. The movable jaw 110 is slotted, and the movable jaw 110 is configured to straddle the guide member 142. The guide member 142 is configured to support linear movement of the movable jaw 110 relative to the stationary jaw 106. Preferably, the movable jaw 110 is configured to pivot slightly on the elongated rotatable shaft 134 (this is done in such a way that the movable gripping teeth 112 may have better opportunity to effectively grip an irregularly shaped instance of the elongated stationary object 904.

Figure 3A:
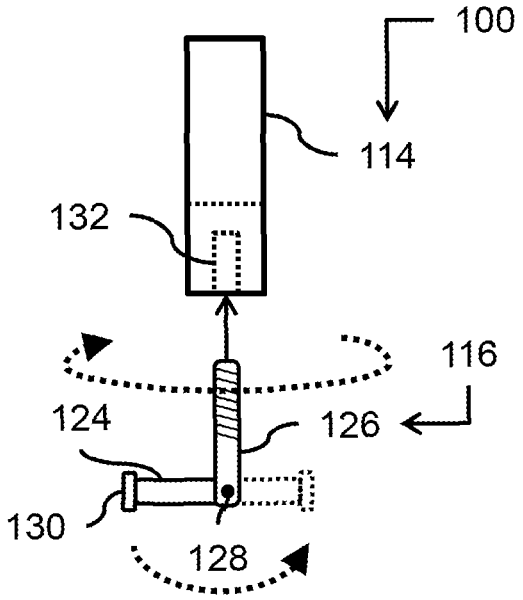
FIG. 3A, FIG. 3B and FIG. 3C (SHEET 4 of 6 SHEETS) depict a front view, a front view and a side view (respectively) of embodiments of a swivel connector of the apparatus of FIG. 1.

Preferably, the clamp portion 104 defines (provides) a channel 144. The channel 144 is configured to receive the swivel connector 116 (which is depicted in FIG. 3A). In accordance with an option, the channel 144 (of the clamp portion 104) may define internal threads, and the swivel connector 116 may define external threads configured to threadably couple with the internal threads of the channel 144 (if so desired).

Referring to the embodiment as depicted in FIG. 2C, once the stationary gripping teeth 108 and the movable gripping teeth 112 of the clamp device 102 are detached and removed from the portion of the elongated stationary object 904 (in response to the movable jaw 110 moving away from the stationary jaw 106), the forestock-support member 114 may be removed from the clamp portion 104.

In accordance with an embodiment, the clamp device 102 has a camouflaged pattern (if so desired) placed on the outer surface of the clamp device 102. In accordance with an embodiment, the clamp device 102 has a rubber coating configured to reduce noise (in case the firearm 900 (in use) inadvertently strikes the clamp device 102 thereby causing an unwanted noise that may scare off an animal passing by).

Preferably, the clamp device 102 and the clamp portion 104 has a rubber coating configured to (A) reduce noise in case the firearm 900 (in sue) inadvertently strikes the clamp device 102, and (B) to improve grip onto the forestock 902 and the barrel section 905, and reduce opportunity of unwanted relative sliding.

In accordance with a preferred embodiment, the movable jaw 110 is configured to pivot (relatively slightly) relative to an end section of the elongated rotatable shaft 134 (so that irregularly shaped instances of the elongated stationary object 904 may be accommodated). A lock 146 is configured to selectively lock the position of the movable jaw 110 against the elongated stationary object 904 (so that the movable jaw 110 does not move relative to the elongated stationary object 904). The lock 146 may include a pair of nuts threadably connected to and movable along the elongated rotatable shaft 134.

Figure 3B:
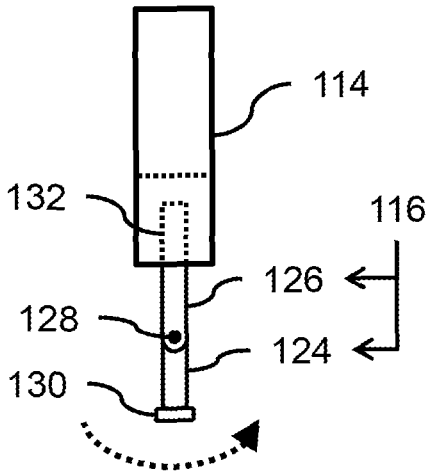
Figure 3C:
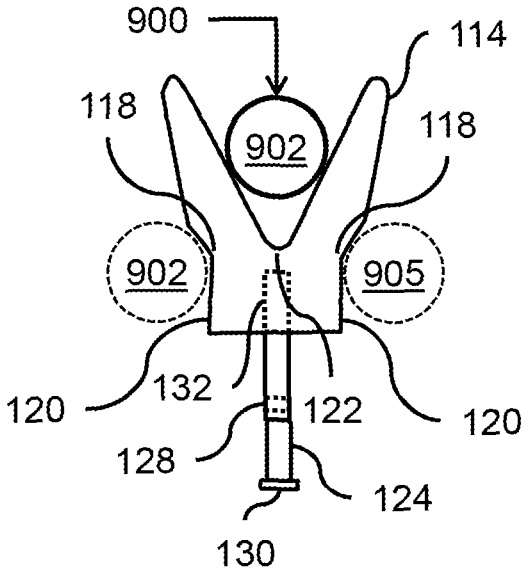

FIG. 3A, FIG. 3B and FIG. 3C depict a front view (FIG. 3A), a front view (FIG. 3B) and a side view (FIG. 3C) of embodiments of the swivel connector 116 of the apparatus 100 of FIG. 1.

Referring to the embodiments as depicted in FIG. 3A and FIG. 3B, the swivel connector 116 includes a first elongated shaft 124, a second elongated shaft 126, a pin member 128 and a stop portion 130. The second elongated shaft 126 configured to threadably couple with a receiving hole 132 defined by (provided by) the forestock-support member 114. The pin member 128 is configured to pivotally couple the first elongated shaft 124 with the second elongated shaft 126 in such a way that the first elongated shaft 124 may pivot relative to the second elongated shaft 126. The stop portion 130 is positioned on a free end section of the first elongated shaft 124.

Referring to the embodiment as depicted in FIG. 3A, The second elongated shaft 126 includes a distal end section that may be (A) threadably connected to the receiving hole 132 of the forestock-support member 114, (B) frictionally fitted within the receiving hole 132, and/or (C) affixed (glued) to the receiving hole 132 (as may be desired).

In accordance with the embodiment as depicted in FIG. 3C, the forestock-support member 114 includes (forms) a V-shaped formation 122. The forestock 902 (or the barrel section 905) of the firearm 900 is receivable in the middle of the V-shaped formation 122 of the forestock-support member 114. It will be appreciated that any one of the forestock 902 and the barrel section 905 may be positioned against (abut) the forestock-support member 114 (as may be desired by the user).

In accordance with an embodiment as depicted in FIG. 3C, the forestock 902 (or the barrel section 905) further includes a corner section 118 formed on any one of the opposite lateral side walls 120 of the forestock-support member 114, with the V-shaped formation 122 positioned between the opposite lateral side walls of the forestock-support member 114. The forestock 902 (or the barrel section 905) may contact any one of the corner sections 118 formed on any one of the opposite lateral side walls 120 of the forestock-support member 114.

In accordance with an embodiment, the swivel connector 116 has a camouflaged pattern (if so desired) placed on the outer surface of the swivel connector 116. In accordance with an embodiment, the swivel connector 116 has a rubber coating configured to reduce noise (in case the firearm 900 (in use) inadvertently strikes the swivel connector 116, thereby causing an unwanted noise that may scare off an animal passing by).

FIG. 4A, FIG. 4B, FIG. 4C, FIG. 4D and FIG. 4E depict a side view (FIG. 4A), a side view (FIG. 4B), a side view (FIG. 4C), a top view (FIG. 4D) and a top view (FIG. 4E) of embodiments of the apparatus 100 of FIG. 1.

Figure 4A:
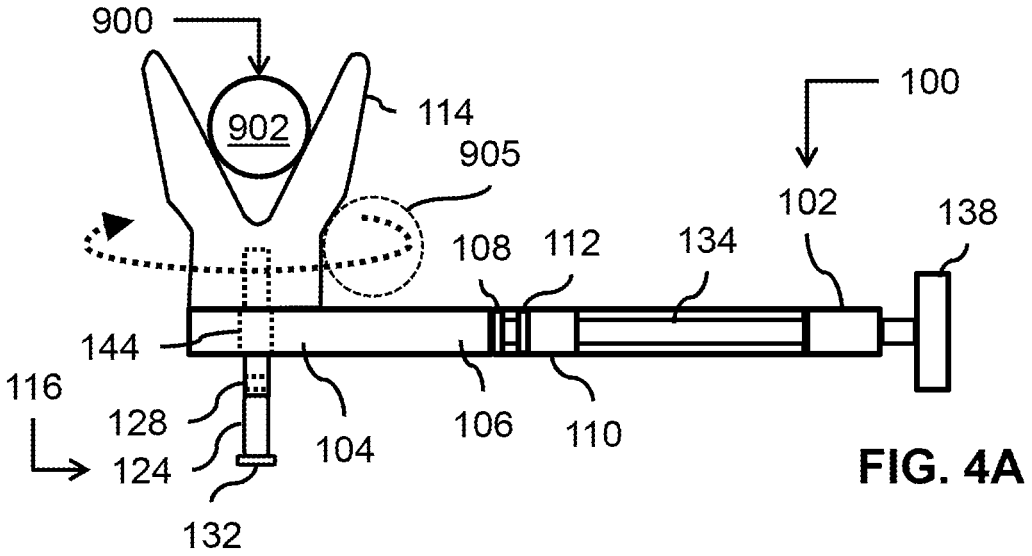
FIG. 4A, FIG. 4B, FIG. 4C, FIG. 4D and FIG. 4E (SHEETS 5 and 6 of 6 SHEETS) depict a side view, a side view, a side view, a top view and a top view (respectively) of embodiments of the apparatus of FIG. 1.
Figure 4B:
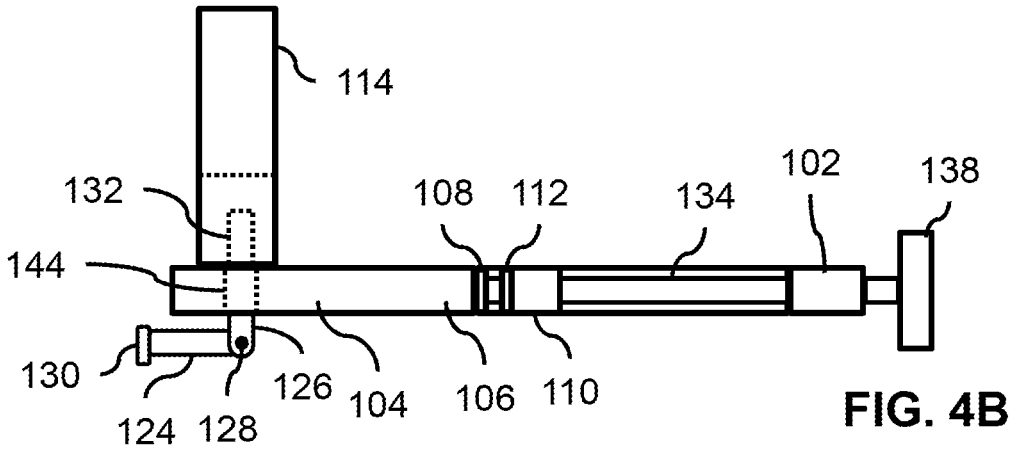

Referring to the embodiment as depicted in FIG. 4A and FIG. 4B, the forestock-support member 114 extends perpendicularly from the clamp device 102 once pivotally attached to do just so (as depicted). The forestock 902 (or the barrel section 905) is depicted as being received in the V-section of the forestock-support member 114. It will be appreciated that any one of the forestock 902 and the barrel section 905 may be positioned against (abut) the forestock-support member 114 (as may be desired by the user). The forestock-support member 114 may be pivotally movable (rotatable) once mounted to the clamp portion 104 (as depicted in FIG. 4A and FIG. 4B).

Figure 4C:
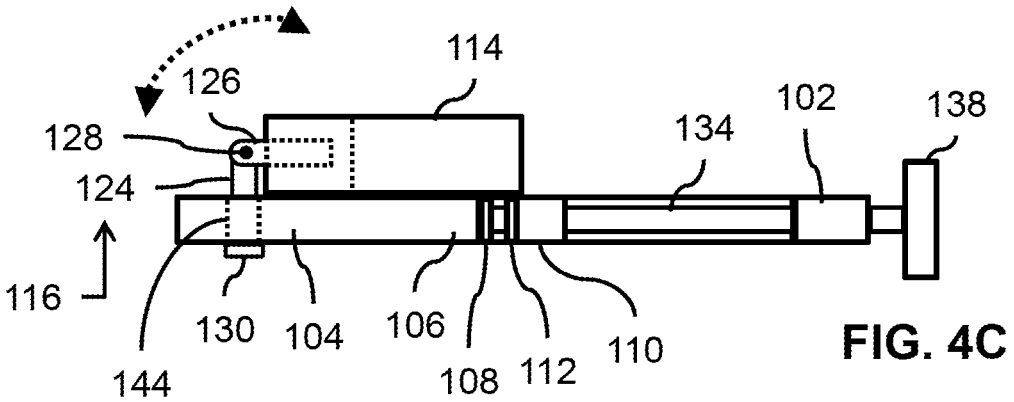

Referring to the embodiment as depicted in FIG. 4C (and in accordance with an option), the channel 144 (of the clamp portion 104) may define internal threads, and the swivel connector 116 may define external threads configured to threadably couple with the internal threads of the channel 144 (if so desired). Preferably the second elongated shaft 126 (of the swivel connector 116) defines (provides) the external threads that are threadably coupled (connectable) with the internal threads of (provided by) the channel 144.

Referring to the embodiment as depicted in FIG. 4C, the swivel connector 116 is configured to loosen in such a way that the forestock-support member 114 no longer contacts the clamp portion 104, and the swivel connector 116 extends the forestock-support member 114 away from the clamp portion 104. A longest length (vertical height) of the forestock-support member 114 may be positioned to contact the claim 102 (in order to reduce the height of the apparatus 100, for storage purposes). FIG. 4C depicts a folded condition of the apparatus 100 (for storage in a knapsack, for instance).

Figure 4D:
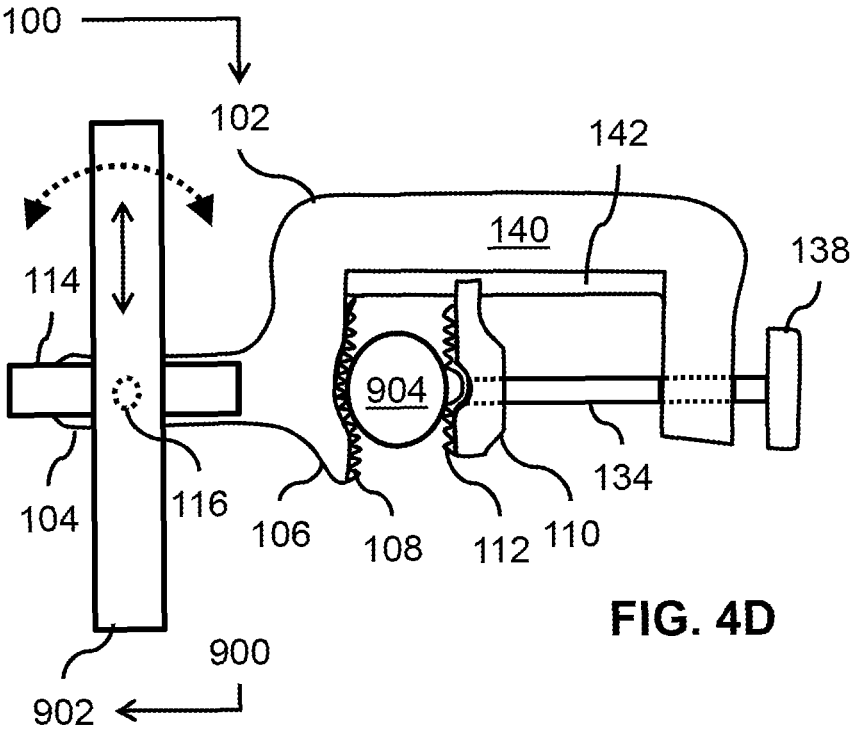
Figure 4E:
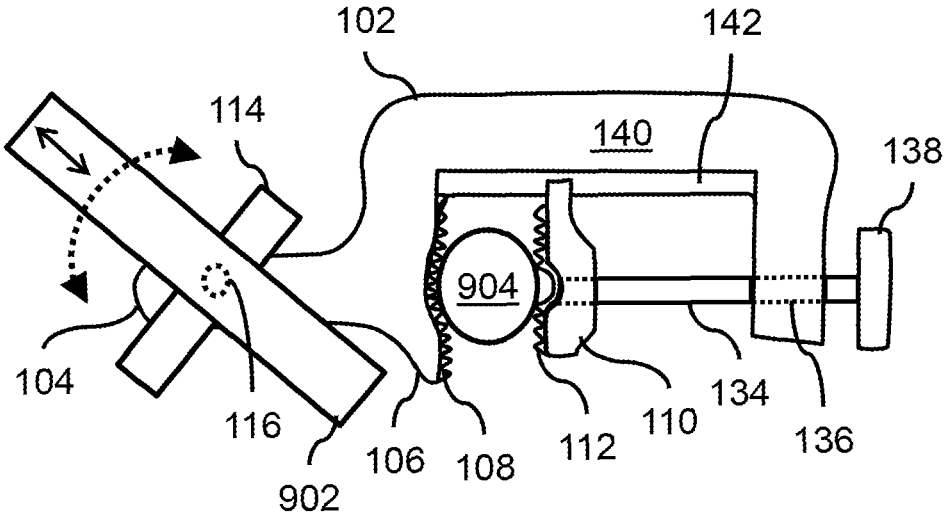

Referring to the embodiments as depicted in FIG. 4D and FIG. 4E, the clamp device 102 is configured to support the forestock 902 of the firearm 900 at a stationary spatial position relative to the elongated stationary object 904 once (A) the stationary gripping teeth 108 and the movable gripping teeth 112 of the clamp device 102 are selectively fixedly securely attached to the elongated stationary object 904, and (B) the forestock-support member 114 (in use) receives, at least in part, the forestock 902 (or the barrel section 905) of the firearm 900.

Referring to the embodiments as depicted in FIG. 4D and FIG. 4E, once the movable jaw 110 is moved toward the stationary jaw 106, the stationary gripping teeth 108 and the movable gripping teeth 112 of the clamp device 102 are selectively fixedly securely attached to the elongated stationary object 904. The swivel connector 116 rotatably connects the forestock-support member 114 to the clamp portion 104 (this is done in such a way that the forestock-support member 114 is spatially positioned relative to the elongated stationary object 904). The user may now position the forestock 902 of the firearm 900 so that the forestock 902 (or the barrel section 905) contacts (abuts) the forestock-support member 114 (this is done in such a way that the forestock-support member 114 spatially supports the forestock 902 (or the barrel section 905) of the firearm 900 relative to the elongated stationary object 904).

Referring to the embodiments as depicted in FIGS. 4D and 4E, the forestock-support member 114 is configured to receive, at least in part, the forestock 902 (or the barrel section 905) of the firearm 900. The forestock-support member 114 is also configured to support the forestock 902 (or the barrel section 905) of the firearm 900 at a stationary spatial position relative to the elongated stationary object 904 once (A) the stationary gripping teeth 108 and the movable gripping teeth 112 of the clamp device 102 are selectively fixedly securely attached to the elongated stationary object 904, and (B) the forestock-support member 114 receives, at least in part, the forestock 902 (or the barrel section 905) of the firearm 900. The forestock-support member 114 is also configured to permit axial sliding movement of the forestock 902 (or the barrel section 905) of the firearm 900 along a length extending through an elongated axis of the forestock 902 (or the barrel section 905) of the firearm 900. The forestock-support member 114 is also configured to restrict radial side-to-side sliding movement of the forestock 902 (or the barrel section 905) of the firearm 900 along a radial cross-section of the forestock 902 (or the barrel section 905) of the firearm 900.

In accordance with a preferred embodiment as depicted in FIG. 4D, the clamp device 102 provides jaw-adjustable cleated clamp members (for instance, the cleated clamp members may provide a jaw opening of about 3.5 inches). Mounted to the clamp members is the forestock-support member 114 forming a V-shaped swivel mount that is configured to support (receive) the firearm 900 (once the firearm 900 is positioned against, or made to abut, the V-shaped swivel mount).

This written description uses examples to disclose the invention, including the best mode, and also to enable any person skilled in the art to make and use the invention. The patentable scope of the invention is defined by the claims, and may include other examples that occur to those skilled in the art. Such other examples are within the scope of the claims if they have structural elements that do not differ from the literal language of the claims, or if they include equivalent structural elements with insubstantial differences from the literal language of the claims.

It may be appreciated that the assemblies and modules described above may be connected with each other as required to perform desired functions and tasks within the scope of persons of skill in the art to make such combinations and permutations without having to describe each and every one in explicit terms. There is no particular assembly or component that may be superior to any of the equivalents available to the person skilled in the art. There is no particular mode of practicing the disclosed subject matter that is superior to others, so long as the functions may be performed. It is believed that all the crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) the description provided outside of this document (that is, outside of the instant application as filed, as prosecuted, and/or as granted). It is understood, for this document, that the phrase "includes" is equivalent to the word "comprising." The foregoing has outlined the non-limiting embodiments (examples). The description is made for particular non-limiting embodiments (examples). It is understood that the non-limiting embodiments are merely illustrative as examples.

What is claimed is:

1. An apparatus for use with a firearm having any one of a forestock and a barrel section, and for use with an elongated stationary object, the apparatus comprising:

a clamp device including a clamp portion; and a forestock-support member being configured to make contact with any one of the forestock and the barrel section of the firearm once the firearm is spatially positioned to do just so; and a swivel connector being configured to extend from, at least in part, the clamp portion, and the swivel connector being configured to rotatably couple the forestock-support member to the clamp portion of the clamp device at a predetermined position on the clamp portion in such a way that the forestock-support member, in use, pivotally swivels at will relative to the clamp portion once any one of the forestock and the barrel section, in use, contacts the swivel connector, and any one of the forestock and the barrel section is made to move just so; and the swivel connector being configured to detach the forestock-support member from the predetermined position on the clamp portion of the clamp device in such a way that the forestock-support member is removable from the clamp portion of the clamp device; and the forestock-support member being configured to support any one of the forestock and the barrel section of the firearm at a spatial position relative to the elongated stationary object once the swivel connector is made to extend from the clamp portion, and the swivel connector is made to rotatably couple the forestock-support member to the clamp portion; and the forestock-support member, in use, makes contact with any one of the forestock and the barrel section of the firearm, once any one of the forestock and the barrel section of the firearm is positioned to do just so, in such a way that any one of the forestock and the barrel section of the firearm and the forestock-support member, in use, swivel at will relative to the clamp portion in response to urging of any one of the forestock and the barrel section of the firearm to cause rotational movement of the forestock-support member; and wherein the swivel connector includes:

a first elongated shaft; and a second elongated shaft; and a pin member; and a stop portion; and wherein:

the second elongated shaft is configured to threadably couple with a receiving hole defined by the forestock-support member; and the pin member is configured to pivotally couple the first elongated shaft with the second elongated shaft in such a way that the first elongated shaft, in use, pivots relative to the second elongated shaft; and the stop portion is positioned on a free end section of the first elongated shaft.

2. The apparatus of claim 1, wherein:

the clamp device further includes:

a stationary jaw extending from the clamp portion, and the stationary jaw being configured to present stationary gripping teeth; and a movable jaw being movably engaged with the clamp portion, in such a way that the movable jaw is movably positionable relative to the stationary jaw; and the movable jaw configured to present movable gripping teeth, with the movable gripping teeth movably facing the stationary gripping teeth of the stationary jaw; and the movable jaw being movable toward the stationary jaw in such a way that, once a cross-sectional portion of the elongated stationary object is positioned between the movable jaw and the stationary jaw, the movable gripping teeth and the stationary gripping teeth selectively fixedly securely attach to the cross-sectional portion of the elongated stationary object so that the clamp portion becomes spatially clamped stationary to the cross-sectional portion of the elongated stationary object; and the movable jaw being movable away from the stationary jaw in such a way that, once the cross-sectional portion of the elongated stationary object is positioned between the movable jaw and the stationary jaw, the movable gripping teeth and the stationary gripping teeth are detached and removable from the cross-sectional portion of the elongated stationary object so that the clamp portion becomes spatially moved away from the elongated stationary object.

3. The apparatus of claim 2, wherein:

the movable gripping teeth and the stationary gripping teeth are movable, at most, to about four inches apart from each other.

4. The apparatus of claim 2, wherein:

the clamp device further includes:

an elongated rotatable shaft extending from the movable jaw; and the elongated rotatable shaft defining, at least in part, outwardly facing threads formed on a surface of the elongated rotatable shaft, and the outwardly facing threads extend along a length of the elongated rotatable shaft.

5. The apparatus of claim 4, wherein:

the clamp device defines a passageway configured to threadably receive and couple with the elongated rotatable shaft;

a handle assembly is fixedly attached to an end portion of the elongated rotatable shaft.

6. The apparatus of claim 5, wherein:

the clamp device includes:

a C-shaped body; and wherein:

the clamp portion extends from the C-shaped body; and the passageway is defined on one side of the C-shaped body, with the stationary jaw positioned on the opposite side of the C-shaped body; and the clamp device also includes a guide member extending along a length of the C-shaped body and faces the elongated rotatable shaft; and the movable jaw is configured to abut and to slide against a length of the guide member; and the guide member is configured to support linear movement of the movable jaw relative to the stationary jaw.

7. The apparatus of claim 2, wherein:

the clamp device is configured to support any one of the forestock and the barrel section of the firearm at a stationary spatial position relative to the elongated stationary object once (A) the stationary gripping teeth and the movable gripping teeth of the clamp device are selectively fixedly securely attached to the elongated stationary object, and (B) the forestock-support member, in use, receives, at least in part, any one of the forestock and the barrel section of the firearm.

8. The apparatus of claim 1, wherein:

the swivel connector is configured to extend through, at least in part, the clamp portion.

9. The apparatus of claim 1, wherein:

the clamp portion defines a channel configured to receive the swivel connector.

10. The apparatus of claim 1, wherein:

the clamp device has a camouflaged pattern placed on an outer surface of the clamp device.

11. The apparatus of claim 1, wherein:

the clamp device and the clamp portion each have a rubber coating configured to: (A) reduce noise in case the firearm, in use, inadvertently strikes the clamp device; and (B) improve grip onto the forestock and the barrel section, and reduce opportunity of unwanted relative sliding.

12. The apparatus of claim 1, wherein:

the forestock-support member includes:

a V-shaped formation in which any one of the forestock and the barrel section of the firearm is receivable in the middle of the V-shaped formation of the forestock-support member.

13. The apparatus of claim 12, wherein:

the forestock-support member further includes:

a corner section formed on any opposite lateral side walls of the forestock-support member, with the V-shaped formation positioned between the opposite lateral side walls of the forestock-support member.

14. The apparatus of claim 1, wherein:

the swivel connector has a camouflaged pattern placed on an outer surface of the swivel connector.

15. The apparatus of claim 1, wherein:

the forestock-support member extends perpendicularly from the clamp device once pivotally attached to do just so.

16. The apparatus of claim 1, wherein:

the swivel connector is configured to be loosened in such a way that the forestock-support member no longer contacts the clamp portion, and the swivel connector extends the forestock-support member away from the clamp portion.

17. The apparatus of claim 1, wherein:

the forestock-support member is also configured to permit axial sliding movement of any one of the forestock and the barrel section of the firearm along a length extending through an elongated axis of any one of the forestock and the barrel section of the firearm; and the forestock-support member is also configured to restrict radial side-to-side sliding movement of any one of the forestock and the barrel section of the firearm along a radial cross-section of any one of the forestock and the barrel section of the firearm.

18. The apparatus of claim 1, wherein:

the clamp device provides jaw-adjustable cleated clamp members; and the forestock-support member is mounted to the jaw-adjustable cleated clamp members; and the forestock-support member is configured to form a V-shaped swivel mount configured to support the firearm once the firearm is positioned against, or made to abut, the V-shaped swivel mount.

19. An apparatus for use with a firearm having any one of a forestock and a barrel section, and for use with an elongated stationary object, the apparatus comprising:

a clamp device including a clamp portion; and a forestock-support member being configured to make contact with any one of the forestock and the barrel section of the firearm once the firearm is spatially positioned to do just so; and a swivel connector being configured to extend from, at least in part, the clamp portion, and the swivel connector being configured to rotatably couple the forestock-support member to the clamp portion of the clamp device at a predetermined position on the clamp portion in such a way that the forestock-support member, in use, pivotally swivels at will relative to the clamp portion once any one of the forestock and the barrel section, in use, contacts the swivel connector, and any one of the forestock and the barrel section is made to move just so; and the swivel connector being configured to detach the forestock-support member from the predetermined position on the clamp portion of the clamp device in such a way that the forestock-support member is removable from the clamp portion of the clamp device; and the forestock-support member being configured to support any one of the forestock and the barrel section of the firearm at a spatial position relative to the elongated stationary object once the swivel connector is made to extend from the clamp portion, and the swivel connector is made to rotatably couple the forestock-support member to the clamp portion; and the forestock-support member, in use, makes contact with any one of the forestock and the barrel section of the firearm, once any one of the forestock and the barrel section of the firearm is positioned to do just so, in such a way that any one of the forestock and the barrel section of the firearm and the forestock-support member, in use, swivel at will relative to the clamp portion in response to urging of any one of the forestock and the barrel section of the firearm to cause rotational movement of the forestock-support member; and the swivel connector has a rubber coating configured to reduce noise in case the firearm, in use, inadvertently strikes the swivel connector causing an unwanted noise.

20. An apparatus for use with a firearm having any one of a forestock and a barrel section, and for use with an elongated stationary object, the apparatus comprising:

a clamp device including a clamp portion; and a forestock-support member being configured to make contact with any one of the forestock and the barrel section of the firearm once the firearm is spatially positioned to do just so; and a swivel connector being configured to extend from, at least in part, the clamp portion, and the swivel connector being configured to rotatably couple the forestock-support member to the clamp portion of the clamp device at a predetermined position on the clamp portion in such a way that the forestock-support member, in use, pivotally swivels at will relative to the clamp portion once any one of the forestock and the barrel section, in use, contacts the swivel connector, and any one of the forestock and the barrel section is made to move just so; and the swivel connector being configured to detach the forestock-support member from the predetermined position on the clamp portion of the clamp device in such a way that the forestock-support member is removable from the clamp portion of the clamp device; and the forestock-support member being configured to support any one of the forestock and the barrel section of the firearm at a spatial position relative to the elongated stationary object once the swivel connector is made to extend from the clamp portion, and the swivel connector is made to rotatably couple the forestock-support member to the clamp portion; and the forestock-support member, in use, makes contact with any one of the forestock and the barrel section of the firearm, once any one of the forestock and the barrel section of the firearm is positioned to do just so, in such a way that any one of the forestock and the barrel section of the firearm and the forestock-support member, in use, swivel at will relative to the clamp portion in response to urging of any one of the forestock and the barrel section of the firearm to cause rotational movement of the forestock-support member; and the clamp device further includes:

a stationary jaw extending from the clamp portion, and the stationary jaw being configured to present stationary gripping teeth; and a movable jaw being movably engaged with the clamp portion, in such a way that the movable jaw is movably positionable relative to the stationary jaw; and the movable jaw configured to present movable gripping teeth, with the movable gripping teeth movably facing the stationary gripping teeth of the stationary jaw; and the movable jaw being movable toward the stationary jaw in such a way that, once a cross-sectional portion of the elongated stationary object is positioned between the movable jaw and the stationary jaw, the movable gripping teeth and the stationary gripping teeth selectively fixedly securely attach to the cross-sectional portion of the elongated stationary object so that the clamp portion becomes spatially clamped stationary to the cross-sectional portion of the elongated stationary object; and the movable jaw being movable away from the stationary jaw in such a way that, once the cross-sectional portion of the elongated stationary object is positioned between the movable jaw and the stationary jaw, the movable gripping teeth and the stationary gripping teeth are detached and removable from the cross-sectional portion of the elongated stationary object so that the clamp portion becomes spatially moved away from the elongated stationary object; and the clamp device further includes:

an elongated rotatable shaft extending from the movable jaw; and the elongated rotatable shaft defining, at least in part, outwardly facing threads formed on a surface of the elongated rotatable shaft, and the outwardly facing threads extend along a length of the elongated rotatable shaft; and the clamp device defines a passageway configured to threadably receive and couple with the elongated rotatable shaft;

a handle assembly is fixedly attached to an end portion of the elongated rotatable shaft; and the clamp device includes:

a C-shaped body; and wherein:

the clamp portion extends from the C-shaped body; and the passageway is defined on one side of the C-shaped body, with the stationary jaw positioned on the opposite side of the C-shaped body; and the clamp device also includes a guide member extending along a length of the C-shaped body and faces the elongated rotatable shaft; and the movable jaw is configured to abut and to slide against a length of the guide member; and the guide member is configured to support linear movement of the movable jaw relative to the stationary jaw.

* * * * *